US006457337B1

(12) United States Patent
Hattick et al.

(10) Patent No.: US 6,457,337 B1
(45) Date of Patent: Oct. 1, 2002

(54) KEY, LOCK, AND KEY AND LOCK SYSTEM

(75) Inventors: John B. Hattick; John H. Rolin, both of Morgan Hill; Victor A. Vega, Sunnyvale, all of CA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/593,337

(22) Filed: Jun. 14, 2000

(51) Int. Cl.[7] ..... H01H 27/00

(52) U.S. Cl. ..... 70/278.3; 70/395; 70/279.1; 70/283.1

(58) Field of Search ..... 700/278.3, 278.2, 700/279.1, 283.1, 395, 408, 413, 277

(56) References Cited

U.S. PATENT DOCUMENTS 4,050,063 A * 9/1977 Schull ..... 235/382
4,452,059 A * 6/1984 Sornes ..... 70/278
4,868,409 A * 9/1989 Tanaka et al. ..... 307/10.5
5,175,418 A 12/1992 Tanaka
5,289,177 A * 2/1994 Wake ..... 340/825.31
5,433,096 A * 7/1995 Janssen et al. ..... 70/278.3
5,528,222 A 6/1996 Moskowitz
5,566,441 A 10/1996 Marsh
5,632,168 A * 5/1997 Yano ..... 70/278.3
5,682,143 A 10/1997 Brady
5,732,579 A * 3/1998 D'Hont et al. ..... 70/278.2
5,786,626 A 7/1998 Brady
5,836,187 A * 11/1998 Janssen et al. ..... 70/252
5,847,447 A 12/1998 Rozin
5,850,187 A 12/1998 Carrender
5,854,480 A 12/1998 Noto
5,870,915 A * 2/1999 D'Hont ..... 70/277
6,001,211 A 12/1999 Hiroyuki
6,035,677 A * 3/2000 Janssen et al. ..... 70/278.3
6,155,089 A * 12/2000 Hurskainen et al. ..... 70/278.3
6,164,101 A * 12/2000 Kito et al. ..... 70/278.3
6,227,020 B1 * 5/2001 Lerchner ..... 70/278.3

FOREIGN PATENT DOCUMENTS

EP 0685620 * 1/1995 ..... E05B/49/00

* cited by examiner

*Primary Examiner*—William A. Cuchlinski, Jr.
*Assistant Examiner*—Olga Hernandez
(74) *Attorney, Agent, or Firm*—Steven G. Parmelee; Terri S. Hughes

(57) ABSTRACT

A key (10) includes a transceiver core (12) that couples to antenna electrodes that include all or part of a key shank (11) and an electrically conductive surface (16). The transceiver core (12) utilizes these electrodes (11 and 16) to capacitively transceive information with a reader (41). The reader (41) may, in turn, utilize all or part of a keyed lock cylinder (43) as an antenna electrode.

19 Claims, 1 Drawing Sheet

KEY, LOCK, AND KEY AND LOCK SYSTEM

TECHNICAL FIELD

This invention relates generally to key, lock, and key and lock systems.

BACKGROUND OF THE INVENTION

Keys and locks are well understood in the art. Typically, a key will include a key grip head that can be held and readily manipulated by a human hand, and a key shank attached to the key grip head (those skilled in the art will sometimes refer to a key shank as being comprised of both a shank portion and a bit portion; as used herein, the term "shank" shall be understood to refer to both of these segments). The key shank fits within a corresponding keyed lock cylinder such that, when the key shank comprises an appropriate match to the configuration of the keyed lock cylinder, the key grip head can be rotated, thus causing a mechanism within the keyed lock cylinder to rotate correspondingly and either engage or disengage a corresponding locking mechanism.

As an added security measure, it is also known in the art to combine such a key with a key mounted transceiver that inductively transceives information, using radio frequency magnetic fields, with a reader. For example, some vehicles provide such a key that inductively communicates with a reader that is mounted within the dashboard of the vehicle. These systems transfer energy from the reader to the key mounted transceiver through an air coupled transformer comprised of two inductive elements (each being an antenna), one being mounted in the dashboard and the other in the key mounted transceiver. The inductive antenna (often a coil) of the key mounted transceiver forms a part of a tuned, or resonant, circuit. The inductive antenna of the reader may also form part of the tuned circuit. Such tuned circuits are required to maximize the energy that is coupled to the key mounted transceiver. In accordance with well understood prior art technique, each such tuned circuit comprises at least a capacitor and coil.

Precise control of the tuned circuit elements and the powering frequency are required to assure reliable system operation which causes a corresponding increase in associated product costs. Further, because of antenna size requirements, typical prior art solutions use a ferrite-based antenna to minimize the antenna size. Such materials change in permeability when subjected to mechanical stress. When forming the key grip head using plastic overmolding techniques, mechanical stress can be imposed upon the ferrite antennas that will result in substantial changes in inductance. This can adversely effect the tuned circuit and degrade system performance. Additional mechanical stresses can occur because of temperature changes and the large thermal coefficients of expansion that are experienced during overmolding processes. Because of this, typical prior art key transceivers use transceivers that are encapsulated in glass tubes that can be inserted into the key grip head after the overmolding process to eliminate mechanical stress. This again can significantly increase cost. And, of course, magnetic coupling as relied upon by such an approach can be adversely effected by the presence of metal in the key shank, the lock cylinder or other proximal materials, which can effect cost of a reliable configuration, range, and so forth.

There exists a need for a key, lock, and key and lock system that at least avoids in part some or all of these prior art difficulties.

DETAILED DESCRIPTION OF THE PREFERRED EMBODIMENT

Figure 1:
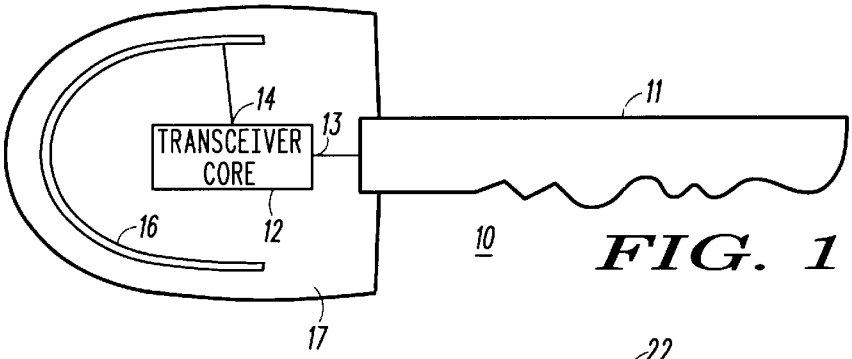
FIG. 1 comprises a diagrammatic side elevational view of a key as configured in accordance with one embodiment of the invention.

Referring now to the drawings and in particular to FIG. 1, a diagrammatic view of a key 10 as configured in accordance with the invention can be seen. The key 10 includes a key shank 11. For convenience and the sake of brevity, as used herein "key shank" includes the key shank portion that is between the key head and the key bit, and also includes the key bit pattern portion as well. In this particular embodiment, the key shank 11 is wholly comprised of electrically conductive material.

The key 10 includes a transceiver core 12 having a first and second terminal 13 and 14 for operably coupling to antenna electrodes. Such a transceiver core is understood in the art and need not be described in more detail here. The key shank 11 serves as a first antenna electrode in this embodiment and operably couples to the first terminal 13 of the transceiver core 12 using an appropriate electrically conductive path. As appropriate to a given application, this path can include, for example, a wire or one or more resistive and/or reactive elements (not shown). So configured, the key shank 11 constitutes a first electrode. The key 10 also includes an electrically conductive surface 16 which serves as a second electrode that couples to the second terminal 14 of the transceiver core 12 using an appropriate conductor, such as a wire. As before, this path may include other elements as desired. The surface 16 may have any kind of shape, with some shapes likely being better suited to various specific applications. The first electrode 11 and the second electrode 16 comprise an antenna to support the capacitive coupling of the transceiver core 12 as described below in more detail. Finally, the key 10 includes a key grip head 17 disposed about the transceiver core 12, the second electrode 16, and a portion of the key shank 11 so as to provide a firm and secure housing to hold these various elements in place and to provide an appropriate surface and body that can be appropriately manipulated by a human hand. (For a given application, it may be desirable to position at least part of the second electrode 16 on the outer surface of the key grip head 17.)

Figure 2:
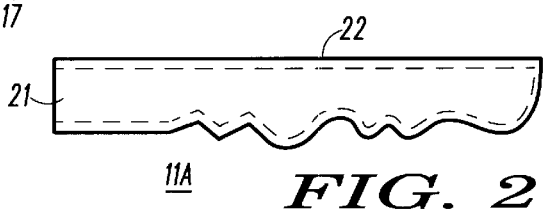
FIG. 2 comprises a side detail view of an alternative embodiment of a key shank.

Referring to FIG. 2, the key shank 11A, in an alternative embodiment, can be comprised of a central core 21 that comprises non-electrically conductive material (such as plastic) and an exterior covering 22 that comprises an electrically conductive material. In such an embodiment, it would be the external electrically conductive covering 22 that would serve as the first electrode and couple to the transceiver core 12. It is not necessary that the key shank 11A be completely covered by an electrically conductive coating 22 as depicted. Rather, only as much electrically conductive surface need be provided as appropriate to the particular application intended. Generally, however, performance will likely be enhanced when the conductive portion extends the full length of the shank.

Figure 3:
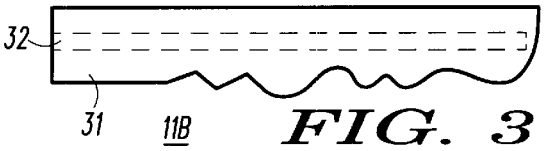
FIG. 3 comprises a side detail view of a further alternative embodiment of a key shank.

Referring to FIG. 3, another key shank embodiment is depicted by reference numeral 11B. In this embodiment, the key shank 11B is comprised of a substantially non-electrically conductive material 31 in which an electrically conductive material 32 has been disposed. In such an embodiment, the inner electrically conductive material 32 would serve as the first electrode and would be coupled to the transceiver core 12 as described above.

Figure 4:
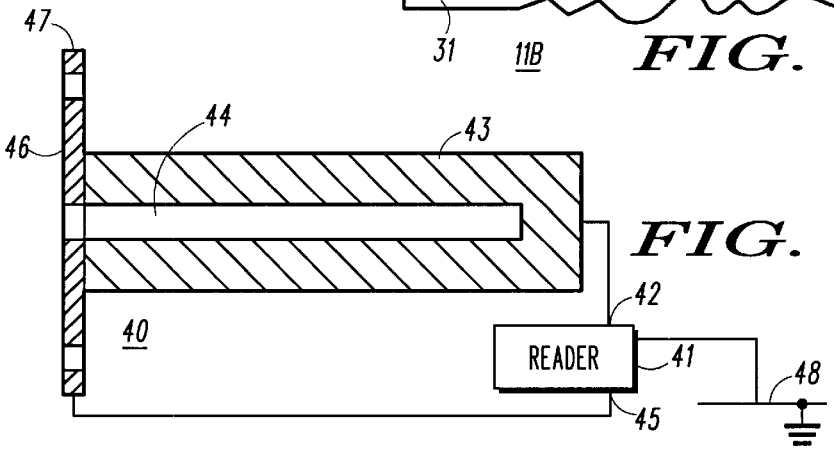
FIG. 4 comprises a top plan sectioned view of a keyed lock cylinder as configured in accordance with the invention.

Referring to FIG. 4, a lock apparatus 40 includes a reader 41, as understood in the art, to power-up and communicate information as capacitively coupled by the transceiver core 12 in the key 10. In this embodiment, the reader 41 has one terminal 42 that couples to a keyed lock cylinder 43, a second terminal 45 that couples to an electrically conductive ring 47, and a third terminal that couples to a common conducting surface 48 in the environment of the reader 41, the key 10, and the holder of the key. In an automobile, this common conducting surface could be the vehicle chassis. This third terminal allows current to return to the reader's signal common. The keyed lock cylinder 43 includes a slot 44 for receiving the key shank 11 as well understood in the art. Additionally, if desired, a facing plate 46 can be provided as also well understood in the art.

The keyed lock cylinder can be comprised of electrically conductive material. By coupling the keyed lock cylinder 43 to the corresponding excitation terminal 42 of the reader 41, the keyed lock cylinder can function as an electrode in an antenna for capacitively coupling power and data to the transceiver core 12 in the key 10. Similarly, the electrically conductive ring 47 as coupled via terminal 45 to the reader 41 allows the electrically conductive ring 47 to serve as another electrode for such an antenna for receiving data from the transceiver.

Figure 5:
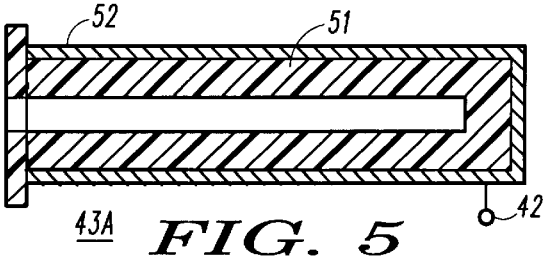
FIG. 5 comprises a sectioned detail view of an alternative embodiment of a keyed lock cylinder.

Referring to FIG. 5, in an alternative embodiment of a keyed lock cylinder 43A, the keyed lock cylinder 51 can be comprised of non-electrically conductive material, such as plastic, and an electrically conductive outer surface 52 can be provided. In this embodiment, the outer coating 52 would couple to the terminal 42 of the reader 41.

Figure 6:
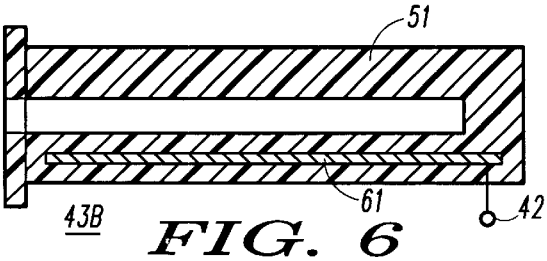
FIG. 6 comprises a sectioned detail view of an alternative embodiment of a keyed lock cylinder.

Referring to FIG. 6, another alternative embodiment of a keyed lock cylinder 43B is depicted. In this embodiment, the main body 51 of the keyed lock cylinder 43B again comprises a non-electrically conductive material, but in this embodiment, an electrically conductive member 61 has been disposed within the keyed lock cylinder main body 51. In this embodiment, it is the electrically conductive member that is internally disposed within the main body 51 that connects to the terminal 42 of the reader 41.

Figure 7:
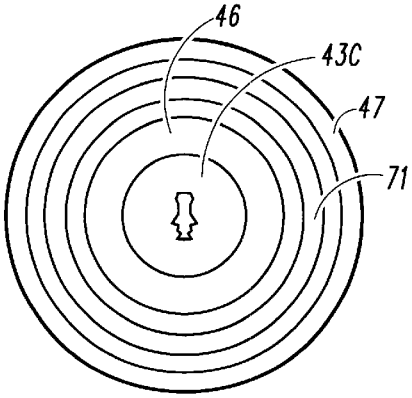
FIG. 7 comprises a front elevational view of an alternative embodiment of a keyed lock cylinder.

Referring to FIG. 7, another alternative embodiment is depicted. In this embodiment, the keyed lock cylinder 43C may, or may not, be comprised fully or partially of electrically conductive material. No portion of the keyed lock cylinder 43C in this embodiment, however, couples electrically to the reader 41. Instead, two electrically conductive rings 71 and 72 disposed concentrically about the keyed lock cylinder 43C are coupled to the reader 41, and hence serve as the antenna electrodes that enable capacitively coupled communications with the key 10.

So configured, and depending upon the particular application, as the key is brought within operating proximity and/or when the key 10 is inserted, in known manner, into the keyed lock cylinder slot 44 the transceiver core 12 can capacitively couple, via the antenna electrodes 11 and 16, to the reader 41. The information so transceived can be used for a variety of purposes, as well understood in the art, and can further include, for example, clock information. The flow of information travels from the key 10 to the reader 41, and, if desired, information can also flow from the reader 41 to the key 10. If desired, the transceiver core 12 can include (or otherwise have access to) memory such that at least some of the information as transmitted by the reader 41 to the key 10 can be selectively stored in the key 10 for subsequent use or recall. In addition, the key and keyed lock cylinder can function mechanically as typically provided in the art.

The human that contacts the key head 17 provides a low impedance path for transceiver return current to the reader. This low impedance path can also include a signal common such as earth ground, a vehicle chassis, a door frame, and other similar structures as appropriate to the particular application. So configured, the described key, lock, and key and lock system eliminates the need for tuned circuits in the key. These components can therefore be overmolded directly in the key grip head without concern that the overmolding process will alter the functionality and operating parameters of the components themselves. This configuration can also operate over a wide frequency range, and is relatively insensitive to the presence of metal as compared to an inductively based transceiving system. This approach provides a substantial cost advantage over inductively coupled solutions.

What is claimed is:

1. An apparatus, comprising:

a transceiver core having at least a first and a second terminal;

an antenna, including:

a first electrode that includes a key shank, which key shank is at least partially comprised of electrically conductive material, which first electrode is operably coupled to the first terminal;

a second electrode comprising at least an electrically conductive surface, which second electrode is operably coupled to the second terminal.

2. The apparatus of claim 1, wherein the transceiver core comprises transceiver means for capacitively transceiving information.

3. The apparatus of claim 1, wherein the antenna comprises antenna means for operably coupling to the terminals.

4. The apparatus of claim 1, wherein the key shank is wholly comprised of electrically conductive material.

5. The apparatus of claim 1, wherein the key shank is further comprised, in part, of non-electrically conductive material.

6. The apparatus of claim 5, wherein at least part of the non-electrically conductive material comprising the key shank is at least partially covered with the electrically conductive material.

7. The apparatus of claim 5, wherein at least part of the electrically conductive material is disposed within at least part of the non-electrically conductive material.

8. The apparatus of claim 1, and further comprising a key grip head that contains the transceiver core and the second electrode.

9. The apparatus of claim 8, wherein the key grip head further contains at least a part of the first electrode.

10. An apparatus, comprising:

a keyed lock cylinder which functions as an antenna, the key locked cylinder is at least partially comprised of an electrically conductive material and operably coupled to a reader, wherein the reader is coupled to the apparatus, and wherein the apparatus, when operable, performs at least one of the following functions: capacitively couples power to a key, capacitively communicates information to the key, and capacitively receives information from the key.

11. The apparatus of claim 10, wherein the reader comprises reader means for reading transceived information.

12. The apparatus of claim 10, wherein the keyed lock cylinder comprises keyed lock cylinder means for receiving the key.

13. The apparatus of claim 10, wherein the keyed lock cylinder is wholly comprised of electrically conductive material.

14. The apparatus of claim 10, wherein the keyed lock cylinder is further comprised, in part, of non-electrically conductive material.

15. The apparatus of claim 14, wherein at least part of the non-electrically conductive material comprising the keyed lock cylinder is at least partially covered with the electrically conductive material.

16. The apparatus of claim 14, wherein at least part of the electrically conductive material is disposed within at least part of the non-electrically conductive material.

17. An apparatus, comprising:

a transceiver core having at least a first and a second terminal;

a transceiver antenna, including:

a first electrode that includes a key shank, which key shank is at least partially comprised of electrically conductive material, which first electrode is operably coupled to the first terminal;

a second electrode comprising at least an electrically conductive surface, which second electrode is operably coupled to the second terminal;

a reader having at least a third terminal.

18. The apparatus of claim 17, and further comprising a reader antenna, including at least a third electrode that includes a keyed lock cylinder, which keyed lock cylinder is at least partially comprised of electrically conductive material, which third electrode is operably coupled to the third terminal.

19. A key, comprising:

a capacitive transceiver core at least partially disposed within the key and having at least a first and second terminal;

a first capacitively coupleable antenna electrode comprising at least a first electrically conductive surface, which first electrode is operably coupled to the first terminal;

a second capacitively coupleable antenna electrode comprising at least a second electrically conductive surface, which second electrode is operably coupled to the second terminal.

* * * * *